US010454252B2

(12) United States Patent
Tanaka et al.

(10) Patent No.: US 10,454,252 B2
(45) Date of Patent: Oct. 22, 2019

(54) SPARK PLUG FOR INTERNAL COMBUSTION ENGINE

(71) Applicant: DENSO CORPORATION, Kariya, Aichi-pref. (JP)

(72) Inventors: Daisuke Tanaka, Nisshin (JP); Fumiaki Aoki, Nisshin (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/143,857

(22) Filed: Sep. 27, 2018

(65) Prior Publication Data

US 2019/0103731 A1 Apr. 4, 2019

(30) Foreign Application Priority Data

Sep. 29, 2017 (JP) ..... 2017-190578

(51) Int. Cl.
*H01T 13/32* (2006.01)
*H01T 13/04* (2006.01)
*H01T 13/38* (2006.01)

(52) U.S. Cl.
CPC ..... *H01T 13/32* (2013.01); *H01T 13/04* (2013.01); *H01T 13/38* (2013.01)

(58) Field of Classification Search
CPC ..... H01T 13/32
USPC ..... 313/141
See application file for complete search history.

(56) References Cited

U.S. PATENT DOCUMENTS 6,166,480 A * 12/2000 Ishida ..... H01T 13/20 313/141
7,259,506 B1 * 8/2007 Maxwell ..... H01T 13/20 123/169 EL
2005/0029915 A1 * 2/2005 Yorita ..... H01T 13/39 313/141
2007/0188065 A1 * 8/2007 Ishinada ..... H01T 13/20 313/141
2009/0066211 A1 * 3/2009 Hartmann ..... H01T 13/20 313/141
2010/0264803 A1 * 10/2010 Nunome ..... H01T 13/39 313/141

(Continued)

FOREIGN PATENT DOCUMENTS

JP H09-129356 5/1997
JP 2013191560 A * 9/2013

(Continued)

*Primary Examiner* — Christopher M Raabe
(74) *Attorney, Agent, or Firm* — Nixon & Vanderhye PC

(57) ABSTRACT

A spark plug for an internal combustion engine is provided which has a center electrode and a ground electrode. The ground electrode includes an upright portion extending in a lengthwise direction of the spark plug and an extension bent from the upright portion in a radial direction of the spark plug. The extension has a slant surface which is shaped to be inclined away from the center electrode downstream in a flow of air-fuel mixture within a combustion chamber when the spark plug is mounted in the engine. This results in an increase in in distance by which a starting point on the ground electrode where a spark is created is moved on the slant surface, thereby increasing a length of time the spark is moved downstream and then blown out to increase the probability of successful ignition of the air-fuel mixture.

7 Claims, 13 Drawing Sheets

(56) References Cited

U.S. PATENT DOCUMENTS

| | | | | |
|---|---|---|---|---|
| 2013/0328476 | A1 | 12/2013 | Ban et al. | |
| 2014/0265816 | A1* | 9/2014 | Hanashi | F02P 13/00 313/141 |
| 2014/0318490 | A1 | 10/2014 | Hanashi | |
| 2014/0361676 | A1 | 12/2014 | Ban et al. | |
| 2016/0053733 | A1* | 2/2016 | Aochi | H01T 13/02 313/120 |
| 2017/0234287 | A1* | 8/2017 | Masuda | H01T 13/32 123/594 |

FOREIGN PATENT DOCUMENTS

| | | | | | |
|---|---|---|---|---|---|
| JP | 2014-022300 | | | 2/2014 | |
| JP | 2015124674 | A | * | 7/2015 | H01T 13/32 |
| JP | 2017-079171 | | | 4/2017 | |
| KR | 20090017255 | A | * | 2/2009 | |

* cited by examiner

SPARK PLUG FOR INTERNAL COMBUSTION ENGINE

CROSS REFERENCE TO RELATED DOCUMENT

The present application claims the benefit of priority of Japanese Patent Application No. 2017-190578 filed on Sep. 29, 2017, the disclosure of which is incorporated herein by reference.

BACKGROUND

1. Technical Field

This disclosure relates generally to a spark plug for internal combustion engines.

2. Background Art

Spark plugs are usually used to ignite fuel in internal combustion engines, such as automobile engines. Japanese Patent First Publication No. 2013-98042 discloses a spark plug equipped with a ground electrode and a center electrode. The ground electrode includes a ground electrode body and a ground electrode chip extending from the ground electrode body toward the center electrode. The ground electrode chip protrudes from the center of a width of the ground electrode body. The spark plug, as taught in the above publication, forms a spark gap between a surface of the ground electrode chip which faces the center electrode and the front end of the center electrode.

The end surface of the ground electrode chip which faces the center electrode slants downward toward the head of the length of the spark plug in a direction in which an air-fuel mixture flows through the spark gap. The spark gap, therefore, has the shortest interval between an upstream edge of the end surface of the center electrode chip and the front end of the center electrode and the longest interval between a downstream edge of the end of the center electrode chip and the front end of the center electrode. In other words, the spark gap gradually increases in the direction of the flow of the air-fuel mixture.

With the above arrangements of the spark plug, an initial spark will be created in the shortest interval of the spark gap which is located on the upstream side of the spark gap. This results in an increase in time it takes for the spark to be carried downward and then blown off in order to ensure the stability in igniting the air-fuel mixture using flame.

In the above spark plug, a starting point on the ground electrode where a spark is developed moves in the downstream direction on the end surface of the ground electrode chip which faces the center electrode. This causes a linear distance between the starting points on the center electrode and the ground electrode to increase and the spark to greatly expand in the downstream direction. Such an increase in linear distance between the starting points of the spark minimizes a risk that ends of the expanded spark are shorted and also facilitates the expansion of the spark, which leads to an increase in area of contact between the air-fuel mixture and the spark.

The above spark plug is, however, designed to have the starting point of a spark on the ground electrode which is movable in a range limited to the size of the ground electrode chip affixed to a portion of the width of the ground electrode body, thus having a limitation in expanding the spark. There is, therefore, still room for improvement in expanding the spark to enhance the stability in igniting the air-fuel mixture.

SUMMARY

It is therefore an object of this disclosure to provide a spark plug for an internal combustion engine which has an enhanced ability to ignite an air-fuel mixture.

According to one aspect of this disclosure, there is provided a spark plug for an internal combustion engine which comprises: (a) a hollow cylindrical housing; (b) a hollow cylindrical porcelain insulator which is retained inside the housing; (c) a center electrode which is retained inside the porcelain insulator with a top portion thereof protruding outside the porcelain insulator; and (d) a ground electrode which defines a spark gap between itself and the center electrode.

The ground electrode includes an upright portion which extends from a front end of the housing to a front side of the spark plug and an extension which is bent from the upright portion inwardly in a radial direction of the spark plug.

If a direction which is oriented perpendicular both to an extension lengthwise direction that is a lengthwise direction of the extension and to a plug axial direction that is an axial direction of the spark plug is defined as a lateral direction, and sides opposed to each other in the lateral direction are defined as a Y1 side and a Y2 side, respectively, the extension has an inner slant portion which faces the center electrode and is inclined away from the center electrode from the Y1 side to the Y2 side.

The extension has a first and a second edge which are opposed to each other in the lateral direction. The inner slant portion continuously extends from the first edge to the second edge of the extension.

The inner slant portion of the ground electrode, as described above, extends continuously from the first edge to the second edge of the inner extension surface in the lateral direction, in other words, fully occupies the width of the ground electrode. This results in an increase in distance by which a starting point on the ground electrode where a spark is created is moved on the inner slant portion, thereby increasing a length of time during which the spark is moved downstream in a flow of the air-fuel mixture and then blown out, to increase the probability of successful ignition of the air-fuel mixture, which improves the ability of the spark plug to ignite the air-fuel mixture. The continuous extending of the inner slant portion between the first and second edges of the inner extension surface in the lateral direction, as described above, results in an increase in linear interval between starting points of the spark on the center electrode and the ground electrode, in other words, an increase in distance the starting point on the ground electrode is moved. This minimizes a risk that the spark is shorted early to ground and results in an increase in elongation of the spark to enhance the ability of the spark plug to ignite the air-fuel mixture.

As apparent from the above discussion, this disclosure provides a spark plug for an internal combustion engine which has enhanced ability to ignite an air-fuel mixture.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

Figure 1:
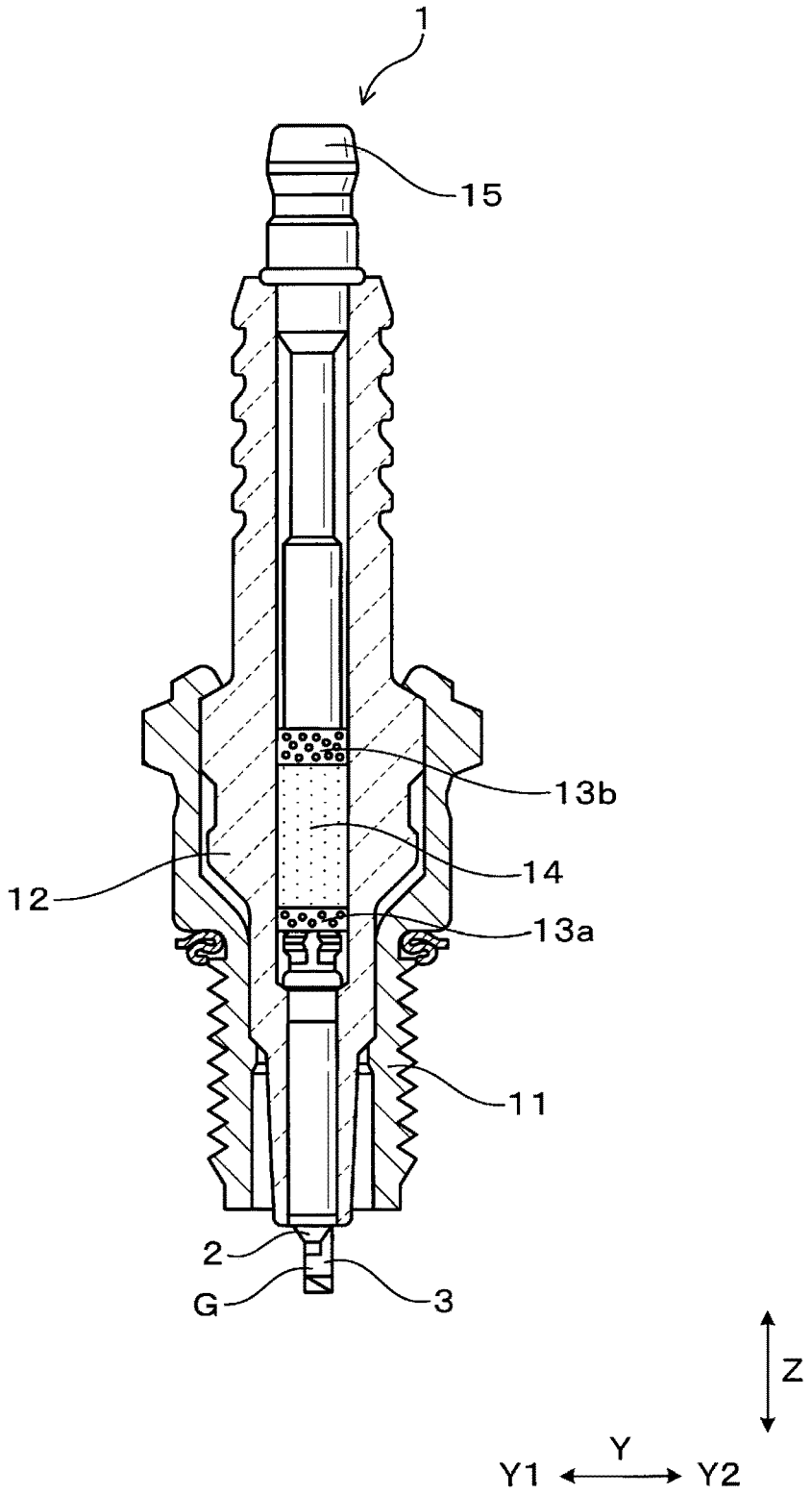
FIG. 1 is a longitudinal sectional view which illustrates a spark plug for an internal combustion engine according to the first embodiment.

The spark plug 1 for an internal combustion engine according to an embodiment will be described below with reference to FIGS. 1 to 8.

The spark plug 1 includes, as shown in FIGS. 1 to 4, the housing (also called a metal shell) 11, the porcelain insulator 12, the center electrode 2, and the ground electrode 3. The housing 11 is of a hollow cylindrical shape. The porcelain insulator 12 is, as clearly illustrated in FIG. 1, retained inside the housing 11. The porcelain insulator 11 is of a hollow cylindrical shape. The center electrode 2 is disposed inside the porcelain insulator 12 with a head or a top portion extending outside an open end of the porcelain insulator 12. The ground electrode 3 creates a spark gap (also called a discharge gap) G between itself and the center electrode 2.

Figure 2:
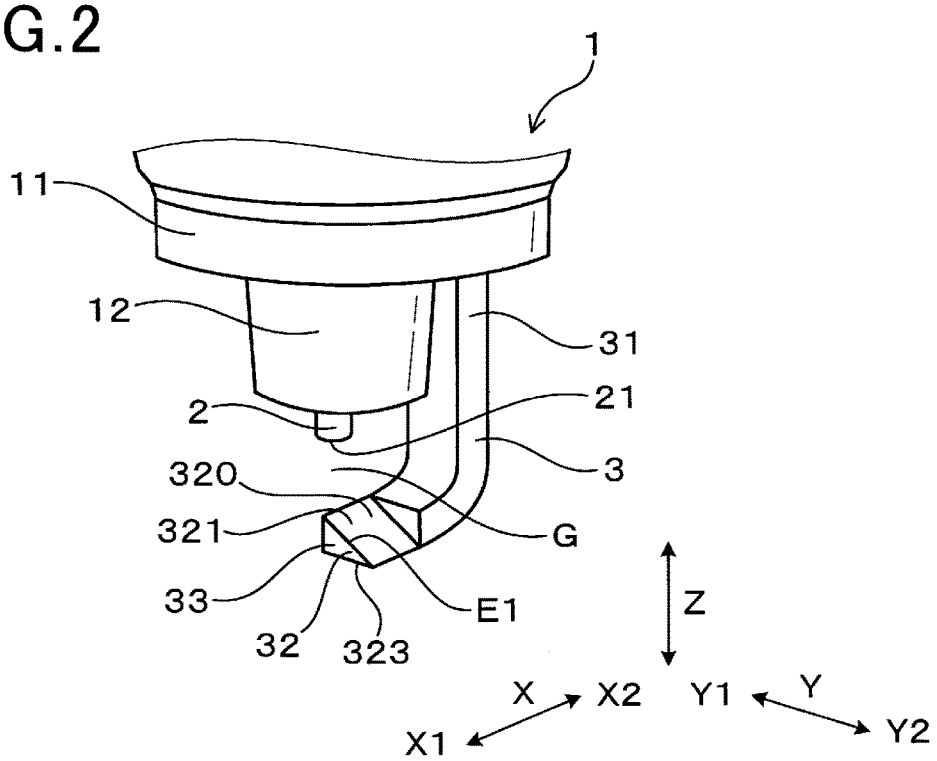
FIG. 2 is a partial perspective view which illustrates a region around a top end of a spark plug for an internal combustion engine according to the first embodiment.
Figure 3:
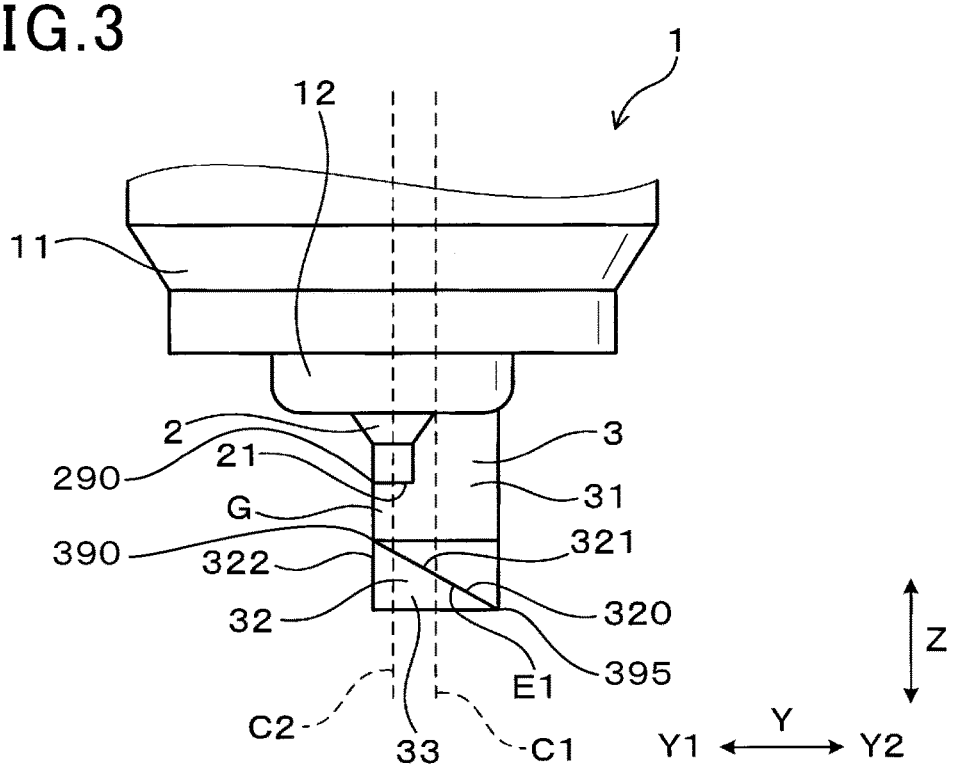
FIG. 3 is a partial front view which illustrates a region around a top end of a spark plug for an internal combustion engine according to the first embodiment.
Figure 4:
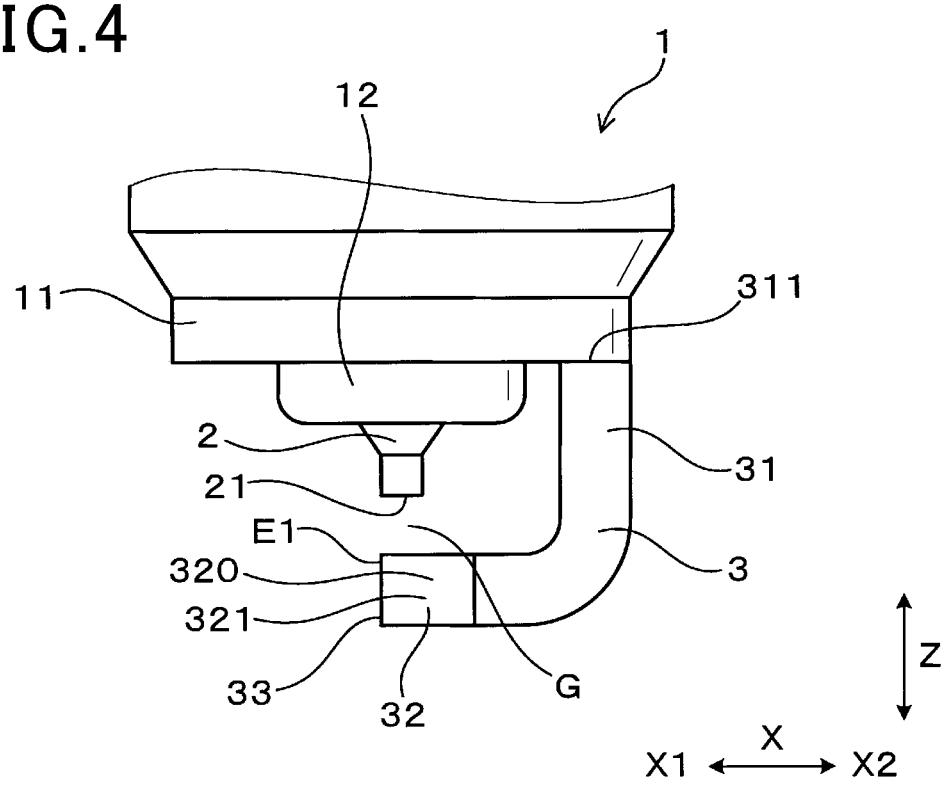
FIG. 4 is a side view which illustrates a region around a top end of a spark plug for an internal combustion engine according to the first embodiment.

The ground electrode 3 is, as illustrated in FIGS. 2 to 4, equipped with the upright portion 31 and the extension 32. The upright portion 31 extends from a front end of the housing 11 outward in a lengthwise direction of the spark plug 1. The extension 32 is, as clearly illustrated in FIGS. 2 and 4, bent from the upright portion 31 inwardly in a radial direction of the spark plug 1. In this disclosure, a direction in which the extension 32 extends from the upright portion 31 is defined as an extension lengthwise direction X. An axial direction (i.e., the longitudinal center line) of the spark plug 1 is defined as a plug axial direction Z. A direction perpendicular to the extension lengthwise direction X and the plug axial direction Z is defined as a lateral direction Y. One of two sides which are opposed to each other in the lateral direction Y will also be referred to as the Y1 side, while the other will be referred to as the Y2 side. The extension 32, as illustrated in FIGS. 2 to 4, has the inner surface 321 (which will also be referred to as an inner extension surface) which faces the head of the center electrode 2 in the plug axial direction Z. The inner surface 321 has formed thereon the slant portion 320 (which will also be referred to as an extension slant portion) which is inclined downward, as viewed in FIG. 3, from the Y1 side to the Y2 side. In the following discussion, one of two sides opposed to each other in the plug axial direction Z will be referred to a top side, while the other will be referred to as a base side. The top side is closer to the head of the spark plug 1 than the base side is. The inner extension surface 321 has a width between edges opposed to each other in the lateral direction Y (i.e., the radial direction of the spark plug 1). The inner slant portion 320 is shaped to extend continuously from one (which will also be referred to below as a first edge) of the edges of the inner extension surface 321 to the other edge (which will also be referred to below as a second edge).

The structure of the spark plug 1 will also be described below in detail.

In this disclosure, the plug axial direction Z is a longitudinal or lengthwise direction of the spark plug 1. The radial direction of the spark plug 1 will also be referred to below as a plug radial direction. One of sides opposed to each other in the longitudinal direction (i.e., the extension lengthwise direction X) of the extension 32 will be referred to as the X1 side, and the other side will be referred to as the X2 side.

The spark plug 1 is used as an igniter in internal combustion engines mounted in, for example, automotive vehicles or cogeneration systems. The spark plug 1 has ends opposed to each other in the plug axial direction Z. One of the ends of the spark plug 1 (which will also be referred to as a base end) is connected to an ignition coil, not shown. The other end of the spark plug 1 (which will also be referred to as a top end) is disposed inside a combustion chamber of the internal combustion engine. In this disclosure, the base end of the spark plug 1 connected to the ignition coil will also be referred to as a base end side, while the front end of the spark plug 1 disposed inside the combustion chamber will also be referred to as a front end side.

The porcelain insulator 12 is, as illustrated in FIG. 1, disposed in the housing 11 and has a front end portion extending outside the front end of the housing 11 and a base end portion extending outside the base end of the housing 11. The porcelain insulator 12 has the center electrode 2 retained inside the front end thereof.

The center electrode 2 is arranged to have a center axis substantially aligned with the center axis of the spark plug 1. The center electrode 2 is of a cylindrical shape as a whole.

The ground electrode 3 is joined to the front end surface of the housing 11. The upright portion 31 is, as clearly illustrated in FIGS. 2 to 4, rectangular in cross section and has a length extending in the plug axial direction Z. The upright portion 31 has a given thickness in the extension lengthwise direction X. The upright portion 31, as can be seen in FIG. 4, has the joint 311 mechanically attached to the housing 11. Specifically, a base end of the upright portion 31 is joined to the front end of the housing 11 to form the joint 311.

The extension 32, as clearly illustrated in FIGS. 2 and 4, extends from the front end of the upright portion 31 inwardly in the plug radial direction. The extension 32 is rectangular in cross section and has a given length oriented in the extension lengthwise direction X. The extension 32 has a given thickness in the plug axial direction Z.

The extension 32 is, as can be seen in FIG. 2, shaped to have a rectangular-triangular transverse section (also called a right-angled triangular cross section). In this embodiment, the whole of the inner surface 321 of the extension 32 may be shaped as the inner slant portion 320. The inner slant portion 320 has a flat surface. The dimension (i.e., the width) of the inner slant portion 320 is, as illustrated in FIGS. 2 and 3, substantially identical with that of the ground electrode 3 in the lateral direction Y. The inner slant portion 320 extends to an edge of the end of the extension 32 on the X1 side. In other words, an outer edge of the inner slant portion 320 in the radial direction (i.e., the extension lengthwise direction X) of the spark plug 1 coincides with that of the inner surface 321 in the radial direction of the spark plug 1.

Specifically, the edge of the inner slant portion 320 on the X1 side, as clearly illustrated in FIGS. 2 to 4, includes the edge E1 that is a boundary between the inner slant portion 320 and the end surface 33 of the ground electrode 3 (i.e., the extension 32) on the X1 side. The edge E1 is, like the inner slant portion 320, inclined at a given angle (excluding zero degree) to the extension lengthwise direction X from a corner of the end surface 33 closest to the center electrode 2 toward the tip of the spark plug 1 in the plug axial direction Z.

When viewed in the extension lengthwise direction X in FIG. 3, the center C1 of the inner surface 321 of the inner slant portion 320 in the lateral direction Y (i.e., a center line extending in the plug axial direction Z through the middle between edges of the width of the extension 32 opposed to each other in the lateral direction Y) is offset to the Y2 side from the center C2 of the front end surface 21 of the center electrode 2 in the lateral direction Y (i.e., a longitudinal center line of the center electrode 2 extending in the axial direction of the spark plug 1). In other words, when viewed in the extension lengthwise direction X, the inner surface 321 is offset from the front end surface 21 of the center electrode 2 to the Y2 side, so that the center C1 is in misalignment from the center C2 in the lengthwise direction of the spark plug 1. When viewed in the extension lengthwise direction X in FIG. 3, the edge 390 of the inner slant portion 320 (i.e., the inner surface 321) on the Y1 side lies in alignment with the edge 290 of the front end surface 21 of the center electrode 2 on the Y1 side in the plug axial direction Z. The edge 390 may alternatively be located closer to the center C1 (i.e., the Y2 side) than the edge 290 is. The edge 290 of the front end surface 21 illustrated in FIG. 3 is a portion of a circumferential outer corner of the center electrode 2 which is located most outward away from the center C1 of the inner slant portion 320 in the width-wise direction of the extension 32 of the ground electrode 3 (i.e., the lateral direction Y). The inner slant portion 320, as clearly illustrated in FIG. 3, has the edge 390 and the edge 395 which are opposed to each other in the lateral direction Y. The edge 390 will also be referred to below as an upstream edge or a first edge, while the edge 395 will also be referred to below as a downstream edge or a second edge. The spark gap G in which sparks are created is formed between the front end surface 21 of the center electrode 2 and an end portion of the inner slant portion 320 on the Y1 side.

The extension 32, as illustrated in FIG. 3, has the extension side surface 322 that is one of side surfaces thereof which lies on the Y1 side, in other words, is located closer to the center C2 than the other side surface. The extension side surface 322 extends perpendicular to the lateral direction Y.

Figure 5:
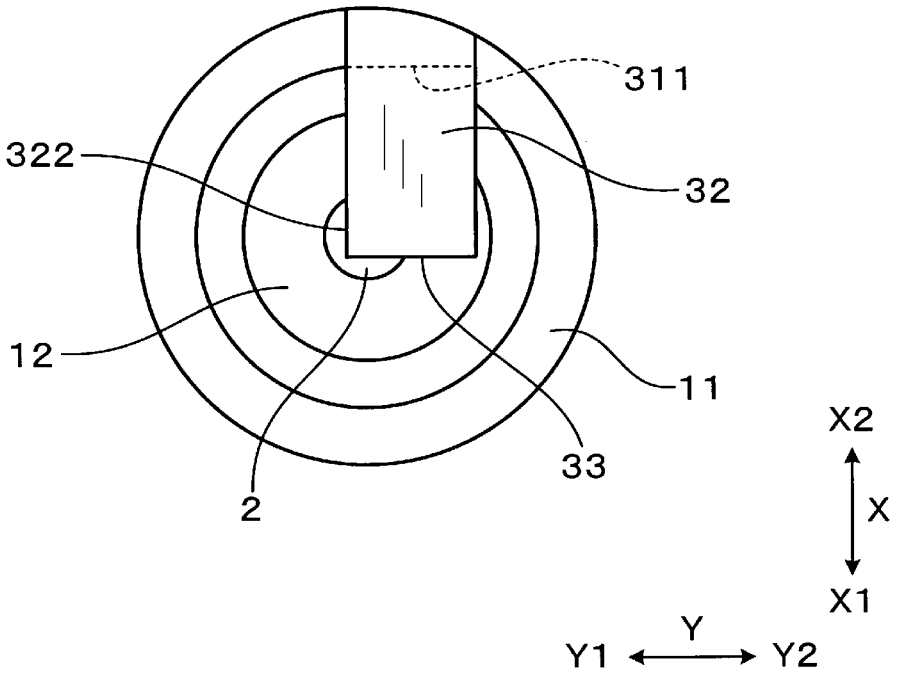
FIG. 5 is a plan view which illustrates a region around a top end of a spark plug for an internal combustion engine according to the first embodiment.

The extension 32, as illustrated in FIGS. 3 and 5, has the outer extension surface 323 which is opposed to the inner extension surface 321 and faces outwardly in the plug axial direction Z. The outer extension surface 323 extends perpendicular to the plug axial direction Z.

The ground electrode 3 is made of a metallic elongated plate. The ground electrode 3 is formed by bending the metallic elongated plate in a thickness-wise direction thereof and then cutting a portion of the plate to form the inner slant portion 320. More specifically, the ground electrode 3 is produced by bending a given portion of a length of the metallic plate which has a rectangular transverse section at right angles and cutting an end portion of the metallic plate to shape the inner slant portion 320. This also forms the upright portion 31 and the extension 32 which are located on opposite sides of the bend of the ground electrode 3.

After being made in the above way, the ground electrode 3 is joined at the upright portion 31 to the front end of the housing 11.

The spark plug 1 also includes, as illustrated in FIG. 1, the resistor 14 arranged above the base end of the center electrode 2 through the electrically conductive glass seal 13*a* within the porcelain insulator 12. The resistor 14 is formed by heating a mixture of resistor material, such as carbon or ceramic powder, and glass powder and sealing it in the porcelain insulator 12. The resistor 14 may alternatively be implemented by a cartridge type resistor inserted into the porcelain insulator 12. The glass seal 13*a* is made of copper glass formed by mixing copper powder with glass. The spark plug 1 also includes the terminal 15 disposed above the base end of the resistor 14 through the glass seal 13*b*. The glass seal 13*b* is made of copper glass. The terminal 15 is made of, for example, iron alloy.

An ignition device which is equipped with the spark plug 1 mounted in an internal combustion engine will be described below.

Figure 6:
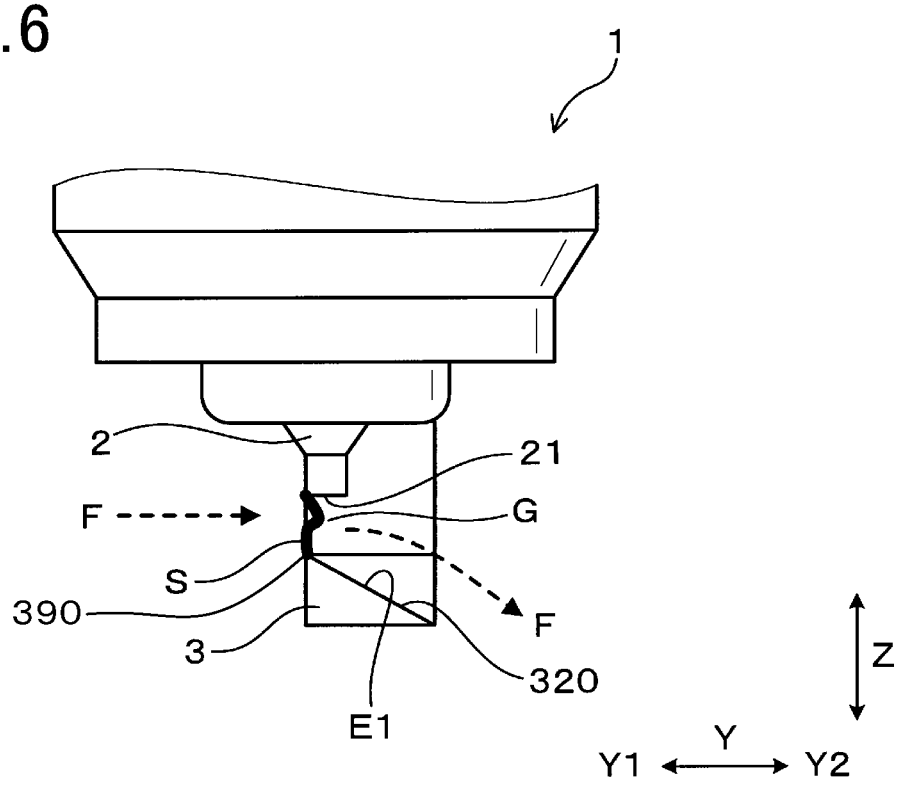
FIG. 6 is a front view which illustrates a region around a top end of a spark plug for an internal combustion engine according to the first embodiment and an explanatory view which demonstrates an initial spark produced in the spark plug.

The spark plug 1 of the ignition device is, as demonstrated in FIG. 6, mounted in the internal combustion engine to have the inner slant portion 320 oriented to slant away from the top end of the center electrode 2 in a direction in which an air-fuel mixture flows through the spark gap G. In other words, the inner slant portion 320 is inclined away from the center electrode 2 in the plug axial direction Z from an upstream side to a downstream side of a flow F of the air-fuel mixture (which will also be referred to below as mixture flow f). In the illustrated example, the Y1 side is the upstream side of the spark gap G, while the Y2 side is the downstream side of the spark gap G. Unless otherwise specified, "upstream side", as referred to in this disclosure, represents the upstream side of the mixture flow F moving through the spark gap G, while "downstream side" represents the downstream side of the mixture flow F moving through the spark gap G.

The flow F of air-fuel mixture around the spark gap G will be described below in detail with reference to FIG. 6.

The mixture flow F moves in the lateral direction Y on the upstream side of the spark gap G. Upon passage of the air-fuel mixture through the spark gap G, the mixture flow F smoothly moves along the inner slant portion 320. In other words, when passing through the spark gap G, the mixture flow F curves or slants toward the tip of the spark plug 1, that is, away from the top of the center electrode 2 as the air-fuel mixture advances to the Y2 side.

Elongation of a spark S developed in the spark gap G resulting from the mixture flow F will be described below with reference to FIGS. 6 to 8.

The spark S is initially developed in the spark gap G when voltage is applied between the center electrode 2 and the ground electrode 3. At the initial stage of the spark discharge in the spark gap G, the spark S usually occurs, as demonstrated in FIG. 6, between the edge 390 of the inner slant portion 320 of the ground electrode 3 and the front end surface 21 of the center electrode 2. This is because an electrical field usually concentrates in a minimum interval between the center electrode 2 and the ground electrode 3 around the edge E1.

Figure 7:
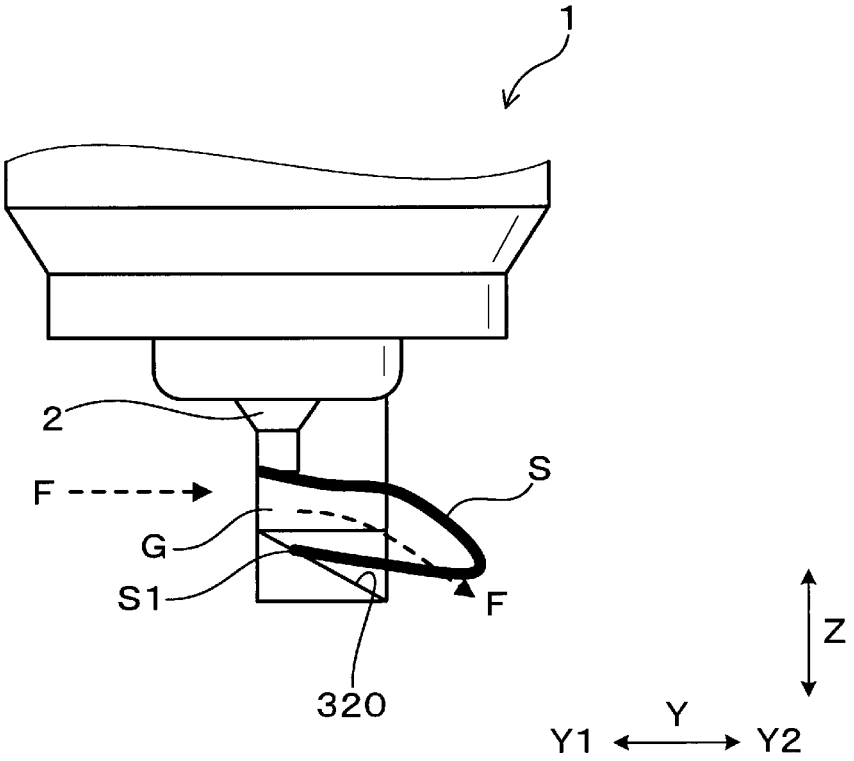
FIG. 7 is a front view which illustrates a region around a top end of a spark plug for an internal combustion engine according to the first embodiment and an explanatory view which demonstrates elongation of an initial spark to a downstream side which results from a flow of air-fuel mixture in a combustion chamber.
Figure 8:
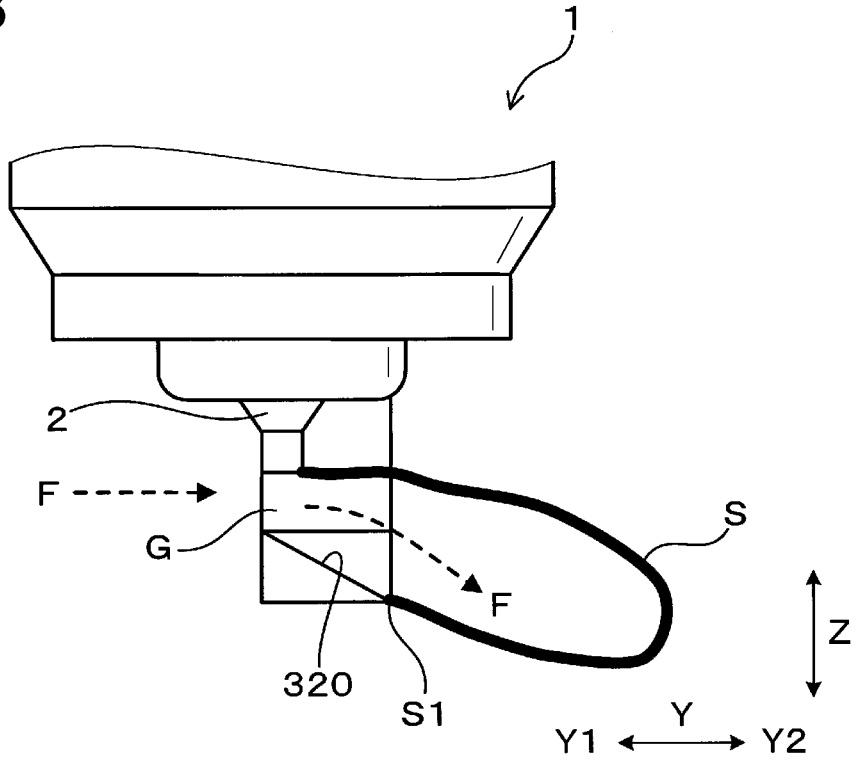
FIG. 8 is a front view which illustrates a region around a top end of a spark plug for an internal combustion engine according to the first embodiment and an explanatory view which demonstrates elongation of a spark when a starting point of the spark on a ground electrode is moved to a downstream end of an inner slant portion of the ground electrode.

The spark S developed initially is then, as illustrated in FIGS. 7 and 8, curved or elongated by the mixture flow F to the downstream side (i.e., the Y2 side). When passing through the spark gap G, the mixture flow F, as described above, gradually slants toward the tip of the spark plug 1 along the inner slant portion 320, thereby causing the spark S to be biased to the tip of the spark plug 1 as well as elongated to the downstream side in the lateral direction Y.

While the spark S is being elongated to the downstream side, a starting point on the ground electrode 3 (which will be referred to below as a ground starting point S1) where the spark S is developed is moved by the mixture flow F from the edge 290 (i.e., the end of the edge E1) to the downstream side. The movement of the ground starting point S1, as can be seen in FIGS. 6 to 8, results in an increase in linear interval between the ground starting point S1 and a starting point on the center electrode 2. A point-to-point line between the ground starting point S1 and the starting point on the center electrode 2 is also elongated obliquely to the tip of the spark plug 1. During such elongation, the air-fuel mixture is ignited by the spark S.

The beneficial advantages offered by the spark plug 1 will be described below.

The inner slant portion 320 of the ground electrode 3, as described above, extends continuously from the edge 390 to the other edge 395 of the inner surface 321 in the lateral direction Y, in other words, fully occupies the width of the ground electrode 3. This results in an increase in distance by which the ground starting point S1 where the spark S is created is moved on the inner slant portion 320, thereby increasing a length of time the spark S is moved downstream and then blown out to increase the probability of successful ignition of the air-fuel mixture, which improves the ability of the spark plug 1 to ignite the air-fuel mixture. The continuous occupation of the inner slant portion 320 between the edges of the inner surface 321 in the lateral direction Y (i.e., the width-wise direction of the ground electrode 3), as described above, results in an increase in linear interval between the starting points on the center electrode 2 and the ground electrode 3, in other words, an increase in distance the ground starting point S1 is moved. This minimizes a risk that the spark S is rapidly shorted to ground and results in an increase in elongation of the spark S to enhance the ability of the spark plug 1 to ignite the air-fuel mixture.

When viewed in the extension lengthwise direction X, the center C1 of the width of the inner surface 321 of the ground electrode 3 is, as described above, offset from the center C2 of the diameter of the front end surface 21 of the center electrode 2 to the Y2 side (i.e., the downstream side), so that the edge 395 of the inner surface 321 facing the Y2 side (i.e., the downstream side) is located farther away from the center electrode 2, thereby resulting in an increase in linear distance between the starting points of the spark S on the center electrode 2 and the ground electrode 3 to enhance the ability of the spark plug 1 to ignite the air-fuel mixture. The edge 390 of the inner surface 321 is located closer to the center electrode 2, so that the edge 390 of the inner surface 321 which faces the upstream side and lies closest to the base end of the spark plug 1 in the plug axial direction Z is located close to the center electrode 2, thereby resulting in a decreased size of the spark gap G, which enables the voltage required to initially develop the spark S to be lowered to reduce mechanical wear of the center electrode 2 and the ground electrode 3.

As apparent from thee above discussion, this embodiment provides the spark plug 1 which is capable of facilitating the ignition of the air-fuel mixture.

Second Embodiment

FIGS. 9 to 12 illustrates the spark plug 1 according to the second embodiment which is different in configuration of the extension 32 from the first embodiment.

Figure 9:
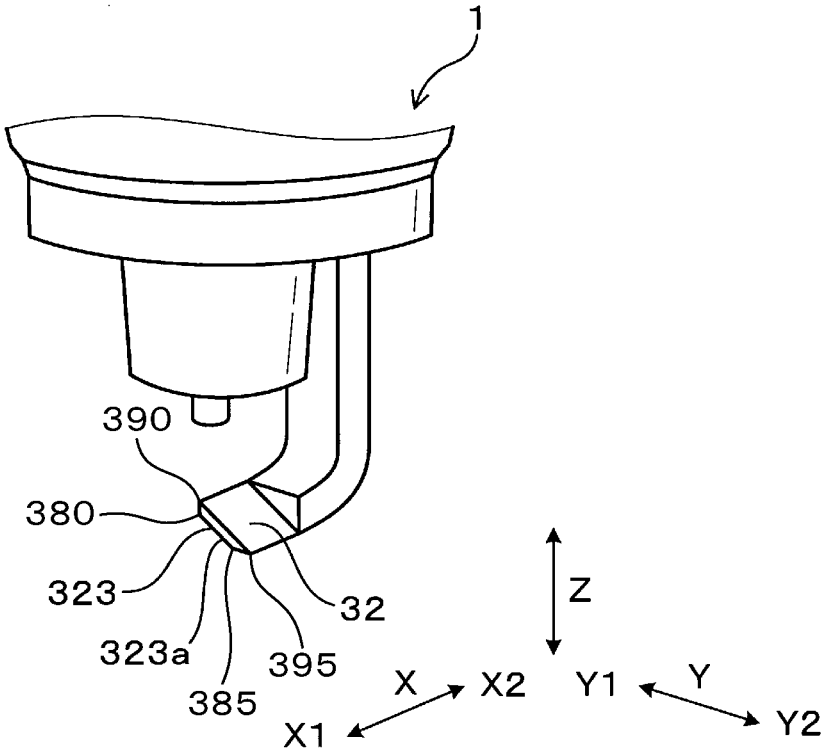
FIG. 9 is a partial perspective view which illustrates a region around a top end of a spark plug for an internal combustion engine according to the second embodiment.
Figure 10:
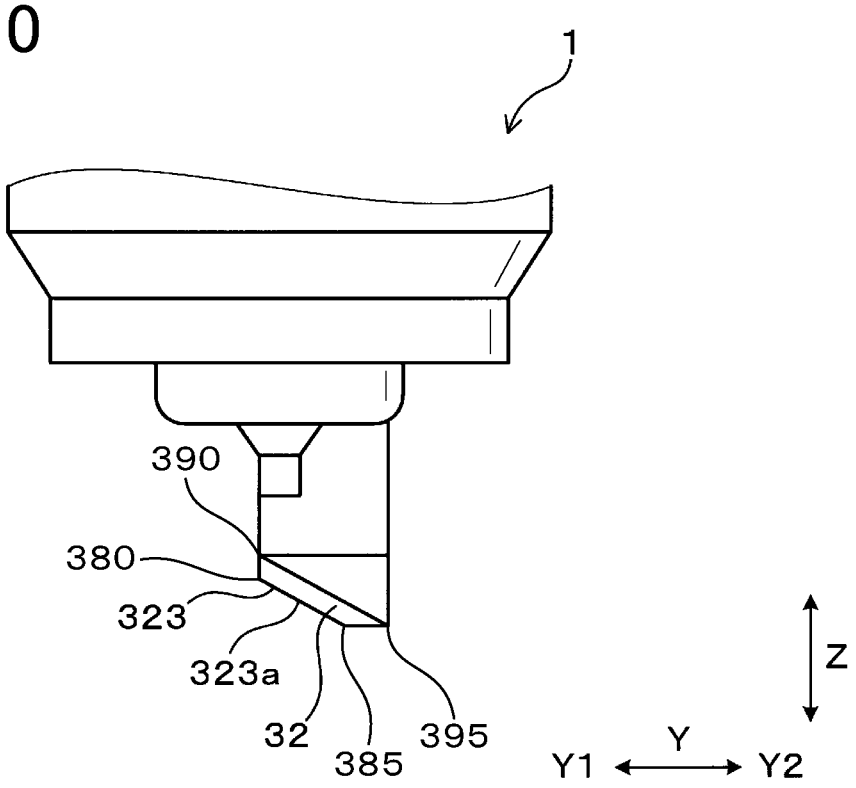
FIG. 10 is a front view which illustrates a region around a top end of a spark plug for an internal combustion engine according to the second embodiment.

The outer extension surface 323 of the extension 32, as illustrated in FIGS. 9 and 10, includes the outer slant portion 323*a* which is inclined from the edge 380 closer to the center electrode 2 (i.e., the upstream side) away from the top surface of the center electrode 2 toward the edge 385 closer to the downstream side. The outer slant portion 323*a* is of a planar shape and extends parallel to the inner slant portion 320. The outer slant portion 323*a* extends from the upstream edge 380 of the outer extension surface 323, but has the downstream edge 385, as clearly illustrated in FIG. 10, located slightly closer to the Y1 side (i.e., the upstream side) than the edge 395 of the outer extension surface 323 is. Note that the edge 395 coincides with downstream edges of the inner extension surface 320 and the outer extension portion 323*a*.

The ground electrode 3 is made of a metallic elongated plate. The ground electrode 3 is formed by bending the metallic elongated plate in the thickness-wise direction thereof and then cutting opposed portions of the plate to form the inner slant portion 320 and the outer slant portion 323*a*.

Figure 11:
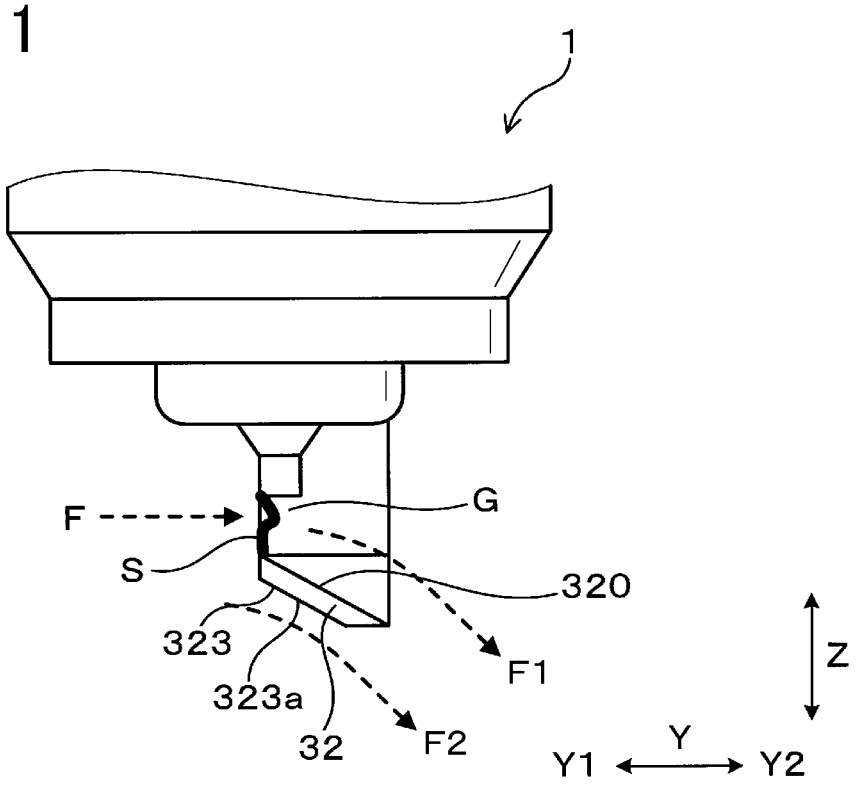
FIG. 11 is a front view which illustrates a region around a top end of a spark plug for an internal combustion engine according to the second embodiment and an explanatory view which demonstrates an initial spark produced in the spark plug.
Figure 12:
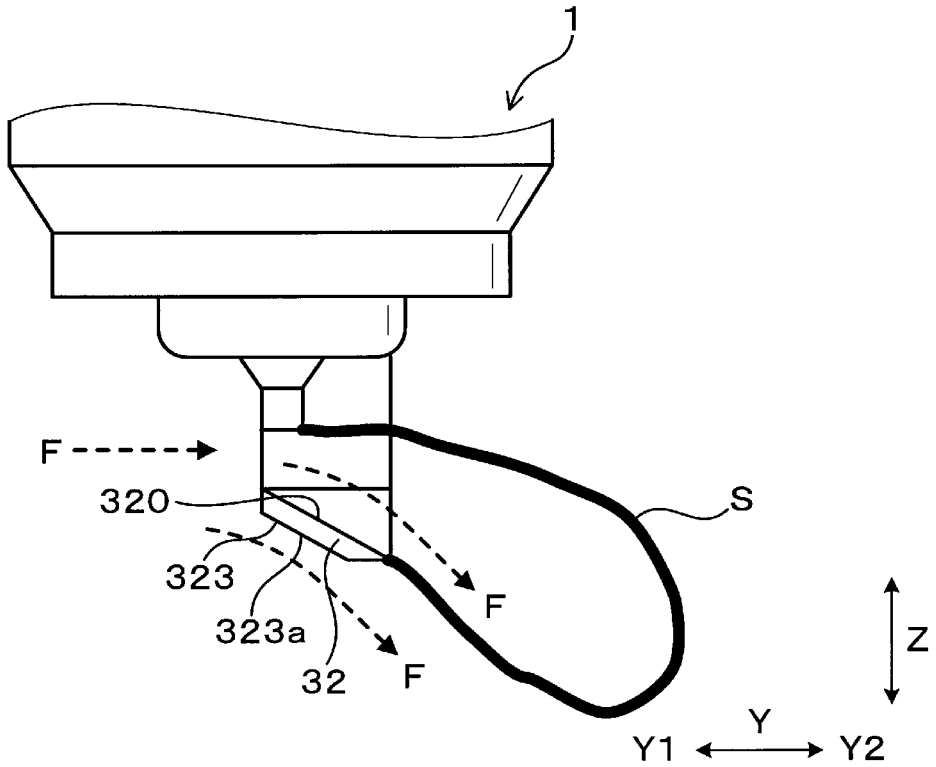
FIG. 12 is a front view which illustrates a region around a top end of a spark plug for an internal combustion engine according to the second embodiment and an explanatory view which demonstrates elongation of a spark when a starting point of the spark on a ground electrode is moved to a downstream end of an inner slant portion of the ground electrode.

The flow F of air-fuel mixture around the spark gap G will be described below in detail with reference to FIG. 11.

The mixture flow F moves in the lateral direction Y on the upstream side of the spark gap G. Upon passage of the air-fuel mixture through the spark gap G, the mixture flow F smoothly moves along the inner slant portion 320 and the outer slant portion 323*a*. In other words, when passing through the spark gap G, the mixture flow F curves or slants toward the tip of the spark plug 1 in the form of a mixture flow F1, that is, away from the top of the center electrode 2 as the air-fuel mixture advances to the Y2 side (i.e., the downstream side). Additionally, the outer slant portion 323*a* produces a mixture flow F1 which curves or slants toward the tip of the spark plug 1, that is, away from the top of the center electrode as the air-fuel mixture advances to the Y2 side. In brief, the extension 32 of the ground electrode 3 works to split the mixture flow F existing upstream of the spark gap G into two streams: the mixture flow F1 and the mixture flow F2 and direct them obliquely downstream away from the top of the center electrode 2.

Other arrangements or operations of the spark plug 1 are identical with those in the first embodiment, explanation thereof in detail will be omitted here.

In the second embodiment and following embodiments, the same reference numbers as employed in the first embodiment refer to the same parts unless otherwise specified.

The outer extension surface 323 is, as described above, equipped with the outer slant portion 323*a* which is inclined away from the top of the center electrode 2 from the upstream edge 380 to the downstream edge 385. This facilitates guiding a stream of air-fuel mixture to the top of the spark plug 1 through the spark gap G. This causes, as demonstrated in FIG. 12, the spark S to be elongated downstream farther away from the top of the center electrode 2, thereby minimizing a risk that heat of a flame, as created by ignition of the air-fuel mixture by the spark S, absorbed by the engine head to facilitate growth of the flame.

Other beneficial advantages offered by the spark plug 1 of the second embodiment are identical with those in the first embodiment.

Third Embodiment

Figure 13:
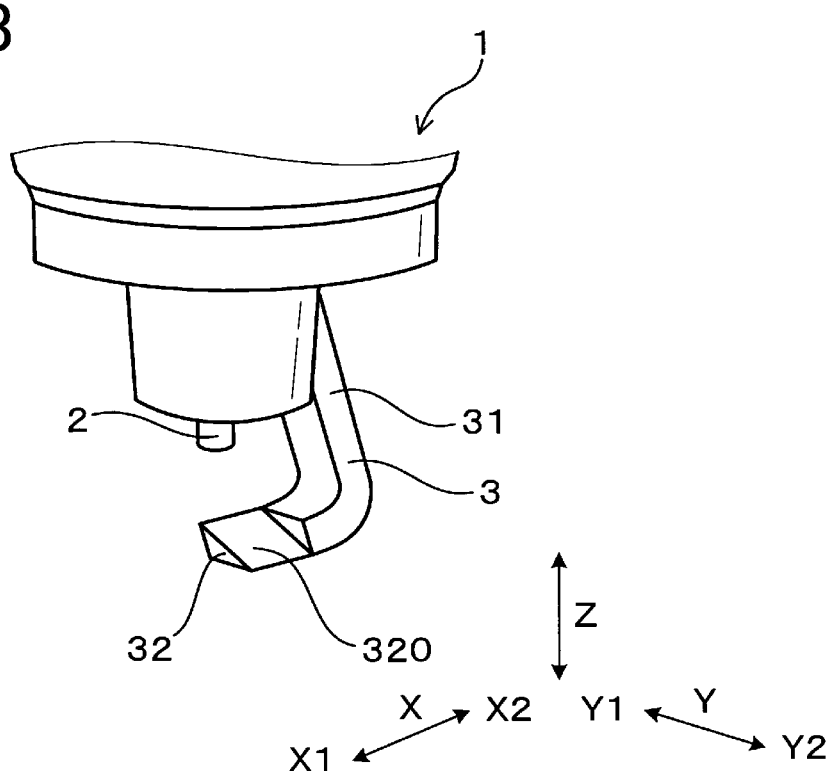
FIG. 13 is a partial perspective view which illustrates a region around a top end of a spark plug for an internal combustion engine according to the third embodiment.
Figure 14:
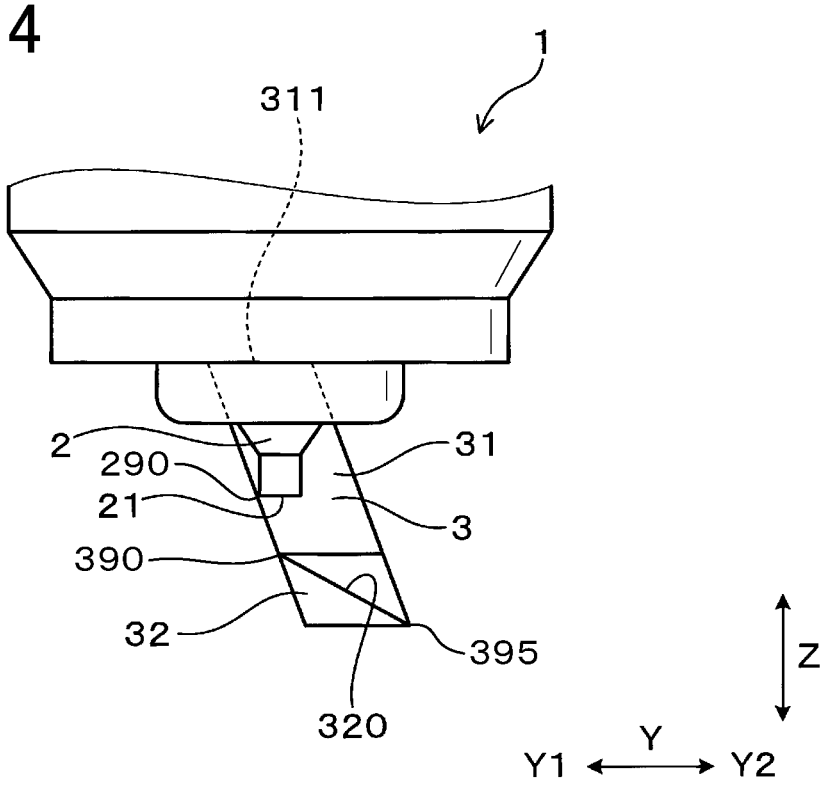
FIG. 14 is a front view which illustrates a region around a top end of a spark plug for an internal combustion engine according to the third embodiment.
Figure 15:
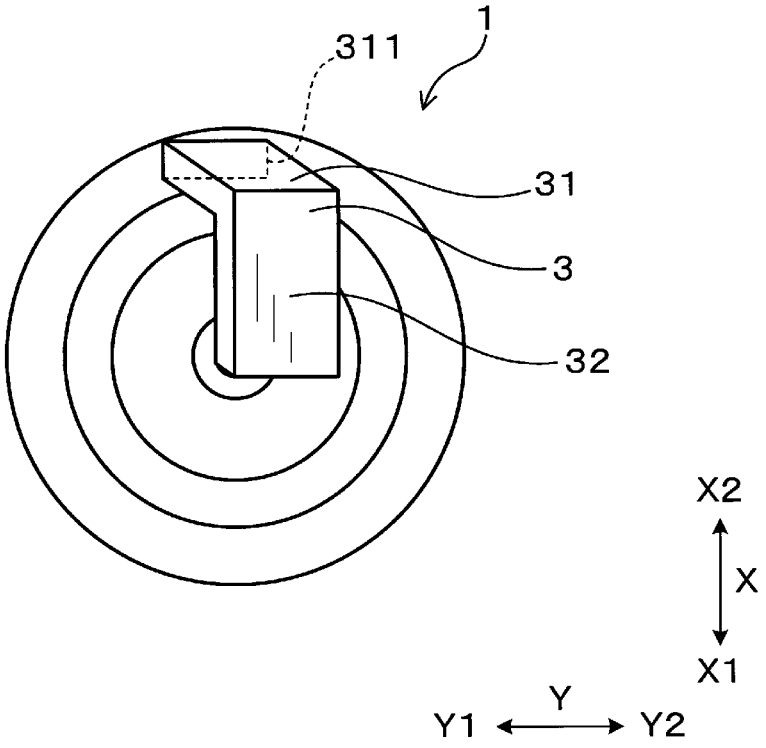
FIG. 15 is a plan view which illustrates a region around a top end of a spark plug for an internal combustion engine according to the third embodiment.

FIGS. 13 to 15 illustrates the spark plug 1 according to the third embodiment which is different in structure of the ground electrode 3 from the first embodiment.

When viewed in the extension lengthwise direction X in FIG. 14, the inner slant portion 320 is offset from the joint 311 of the ground electrode 3 in the lateral direction Y. In other words, the inner slant portion 320 is located out of alignment with the joint 311 of the ground electrode 3 in the plug axial direction Z.

The joint 311 of the upright portion 31, as illustrated in FIG. 15, has an end surface entirely attached to the end surface of the housing 11.

The upright portion 31 of the ground electrode 3 is, as clearly illustrated in FIGS. 13 to 15, inclined from the joint 311 to the Y2 side (i.e., the downstream side). In other words, the upright portion 31 is inclined downstream at a given angle to the longitudinal center line (i.e., the length) of the spark plug 1. The extension 32, as illustrated in FIG. 15, has a length extending parallel to a direction in which the joint 311 of the ground electrode 3 and the center electrode 2 are arranged adjacent each other. The upstream edge 390 of the inner slant portion 320 is, as can be seen in FIG. 14, offset from the upstream edge 290 of the front end surface 21 of the center electrode 2 to the Y2 side (i.e., the downstream side).

Other arrangements are identical with those in the first embodiment.

When viewed in the extension lengthwise direction X, the joint 311 is offset from the inner slant portion 320 in the lateral direction Y. In other words, when viewed in the extension lengthwise direction X, the center C1 of the width of the inner extension surface 321 of the ground electrode 3 is, as illustrated in FIG. 3, offset from the center C2 of the diameter of the front end surface 21 of the center electrode 2 to the Y2 side (i.e., the downstream side), but it permits the location of the joint 311 to be changed as needed. For example, the joint 311 may be designed, as illustrated in FIG. 14, to have a surface entirely facing the front end surface of the housing 11, thereby ensuring a required degree of strength of joint between the ground electrode 3 and the housing 11.

The spark plug 1 of this embodiment offers substantially the same other beneficial advantages as in the first embodiment.

Fourth Embodiment

Figure 16:
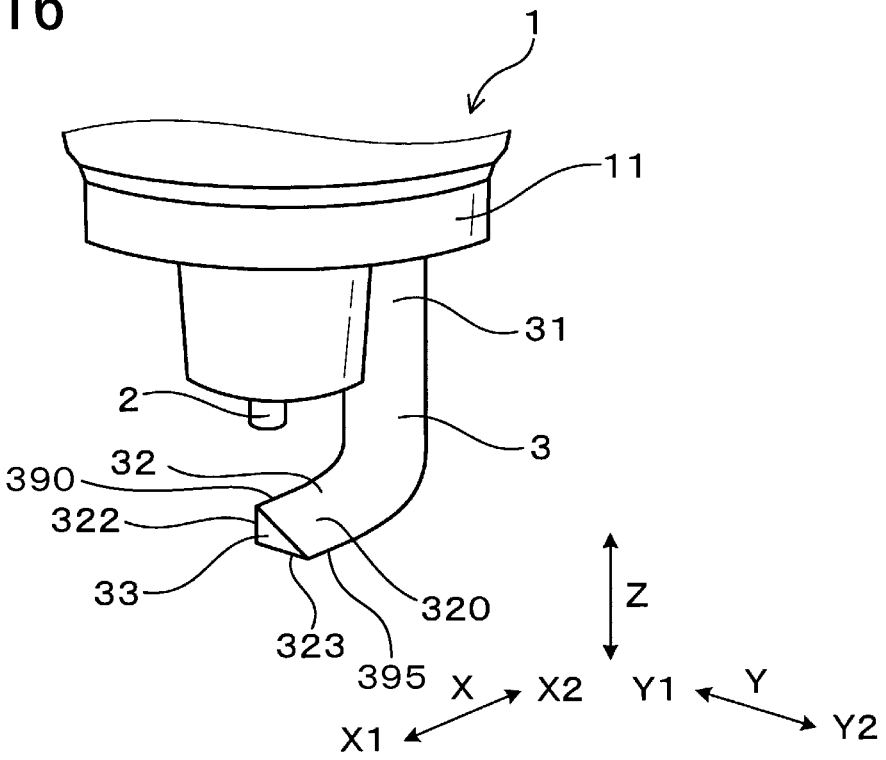
FIG. 16 is a partial perspective view which illustrates a region around a top end of a spark plug for an internal combustion engine according to the fourth embodiment.
Figure 17:
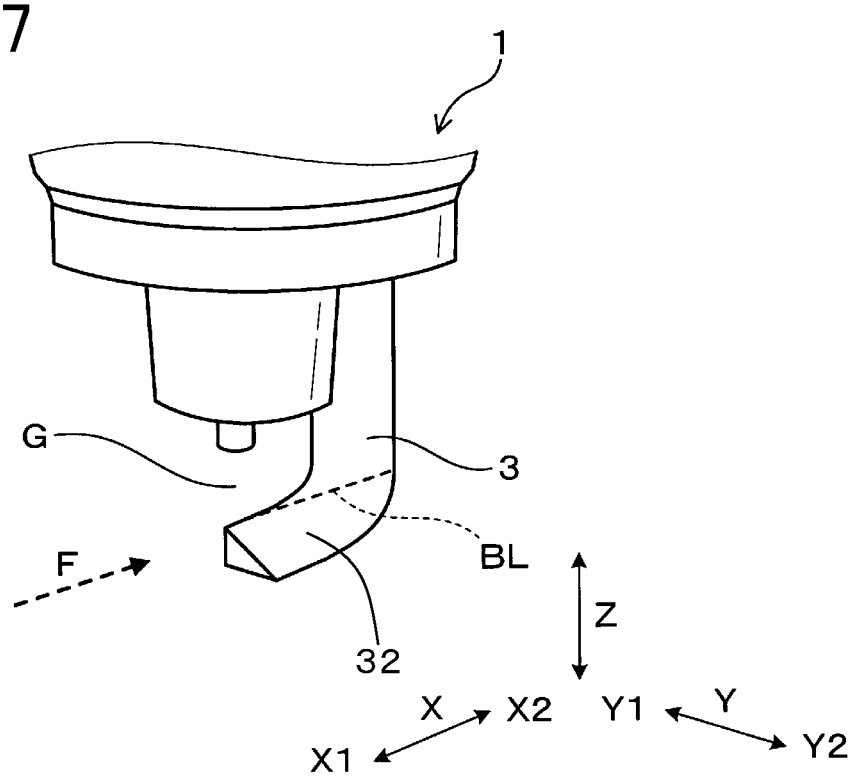
FIG. 17 is a partial perspective view which illustrates a region around a top end of a spark plug for an internal combustion engine according to the fourth embodiment and an explanatory view for describing operation of and beneficial advantages offered by the spark plug.

FIGS. 16 and 17 illustrate the spark plug 1 according to the fourth embodiment which is different in configuration of the ground electrode 3 from the first embodiment.

The ground electrode 3, as can be seen in FIG. 16, has a transverse section whose shape remains unchanged over a length of the ground electrode 3. Specifically, the ground electrode 3 has a right-angled triangular cross section taken in a direction perpendicular to the length of the ground electrode 3. The ground electrode 3 has a surface which defines a hypotenuse of the right-angled triangular cross section and forms a portion of the inner slant portion 320. Such a surface is even and extends entirely between ends of the length of the ground electrode 3.

The inner slant portion 320 is, like in the first embodiment, shaped to be inclined from the upstream edge 390 away from the top of the center electrode 2 to the downstream edge 395. The extension side surface 322 extends perpendicular to the lateral direction Y. The outer extension surface 323 extends perpendicular to the plug axial direction Z.

The ground electrode 3 is made by bending a metallic elongated plate in a thickness-wise direction thereof. The metallic elongated plate has a right-angled triangular cross section. The ground electrode 3 is bent to orient the extension 32 in the above described direction and joined to the housing 11.

Other arrangements are identical with those in the first embodiment.

The configuration of the ground electrode 3 improves the productivity thereof (i.e., the spark plug 1).

The configuration of the ground electrode 3 (i.e., the extension 32) assures an increased distance the starting point of a spark moves on the ground electrode 3 even when the mixture flow F passing through the spark gap G, as illustrated in FIG. 17, crosses the width of the extension 32 diagonally toward the X2 side in the extension lengthwise direction X. The surface of the ground electrode 3 which defines the hypotenuse of the right-angled triangular cross section of the ground electrode 3 is, as described above, even and extends entirely between ends of the length of the ground electrode 3 without any corners, so that the starting point of a spark on the ground electrode 3 may be moved by the mixture flow F along a path, as indicated by a broken line BL in FIG. 17. This facilitates the movement of the starting point of the spark on the ground electrode 3, thereby resulting in an increase in time it takes for the spark to be carried downstream and then blown off and also resulting in an increase in linear distance between the starting points on the center electrode 2 and the ground electrode 3. This enhances the ability of the spark plug 1 to ignite the air-fuel mixture.

The spark plug 1 of this embodiment offers substantially the same other beneficial advantages as in the first embodiment.

Fifth Embodiment

Figure 18:
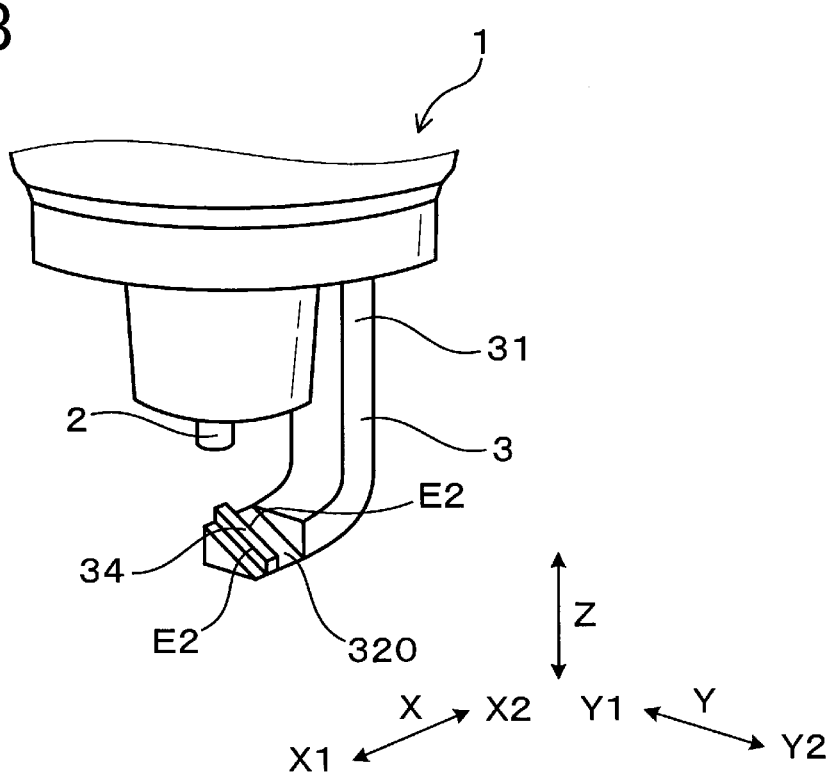
FIG. 18 is a partial perspective view which illustrates a region around a top end of a spark plug for an internal combustion engine according to the fifth embodiment.
Figure 19:
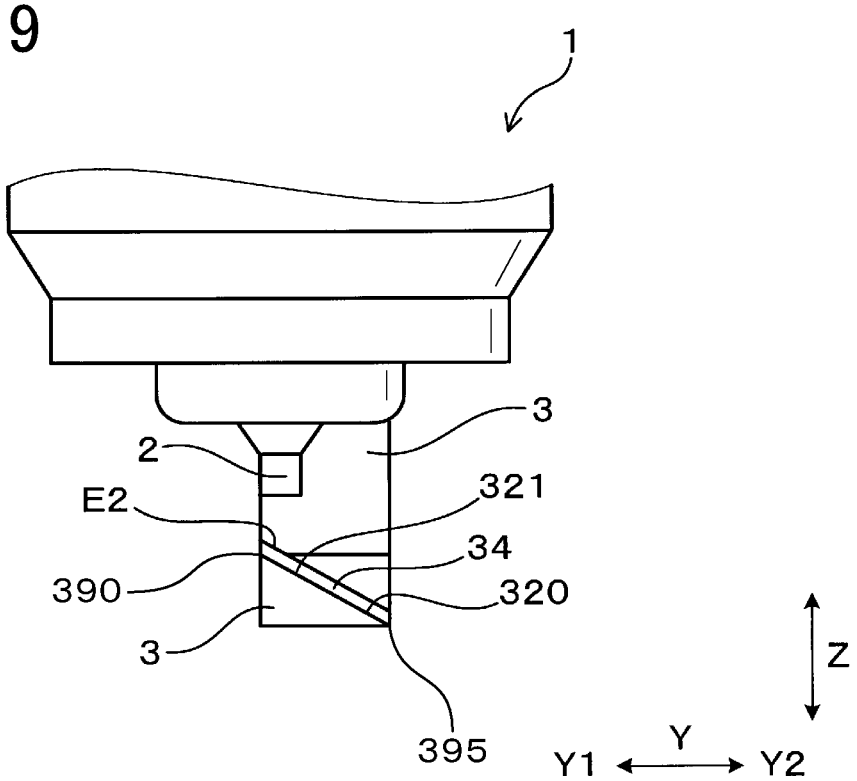
FIG. 19 is a front view which illustrates a region around a top end of a spark plug for an internal combustion engine according to the fifth embodiment.
Figure 20:
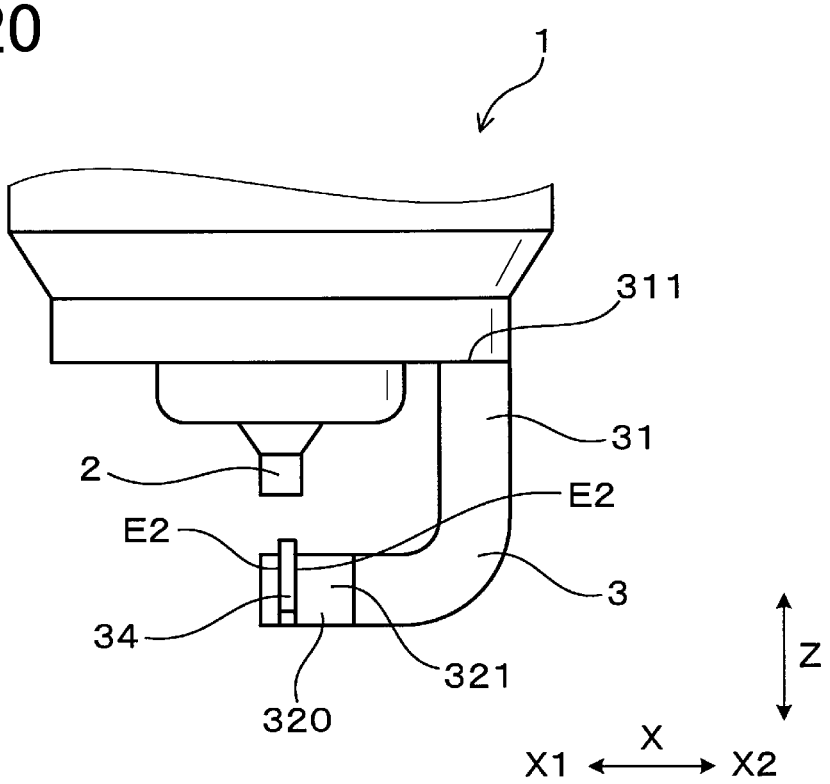
FIG. 20 is a side view which illustrates a region around a top end of a spark plug for an internal combustion engine according to the fifth embodiment.

FIGS. 18 to 20 illustrate the spark plug 1 according to the fifth embodiment which is substantially identical in structure with that in the first embodiment, but has the inner slant portion 320 equipped with the convex portion 34 protruding to the top of the center electrode 2.

The convex portion 34, as illustrated in FIG. 19, has a length extending continuously from the upstream edge 390 to the downstream edge 395 of the inner extension surface 321 in the lateral direction Y. The convex portion 34 is, as clearly illustrated in FIGS. 18 to 20, made of a rectangular elongated bar extending in a direction in which the inner slant portion 320 is inclined. The convex portion 34 has a surface which faces the center electrode 2 and has the edges E2. The edges E2 define a width thereof and are opposed to each other in the extension lengthwise direction X. The edges E2 are inclined away from the top of the center electrode 2 to the Y2 side (i.e., the downstream side). The convex portion 34 is, as can be seen in FIGS. 18 and 20, located substantially at the middle of the width of the inner extension surface 321 in the extension lengthwise direction X.

The convex portion 34 may be made of material different from that of the ground electrode 3. For example, the ground electrode 3 is made Ni alloy mainly containing nickel. The convex portion 34 is made of a noble metal such as Ir or Pt. The convex portion 34 is welded to the material of the ground electrode 3.

Other arrangements are identical with those in the first embodiment.

The convex portion 34 facilitates concentration of electrical field around the edges E2, thereby ensuring the stability of movement of the ground starting point S1 of the spark S, thereby resulting in an increase in time it takes for the spark S to be carried downstream and then blown off and also resulting in an increase in linear distance between the starting points on the center electrode 2 and the ground electrode 3. This enhances the ability of the spark plug 1 to ignite the air-fuel mixture.

The use of the high-stiffness noble metal as material of the convex portion 34 minimizes mechanical wear thereof.

The spark plug 1 of this embodiment offers substantially the same other beneficial advantages as in the first embodiment.

Sixth Embodiment

Figure 21:
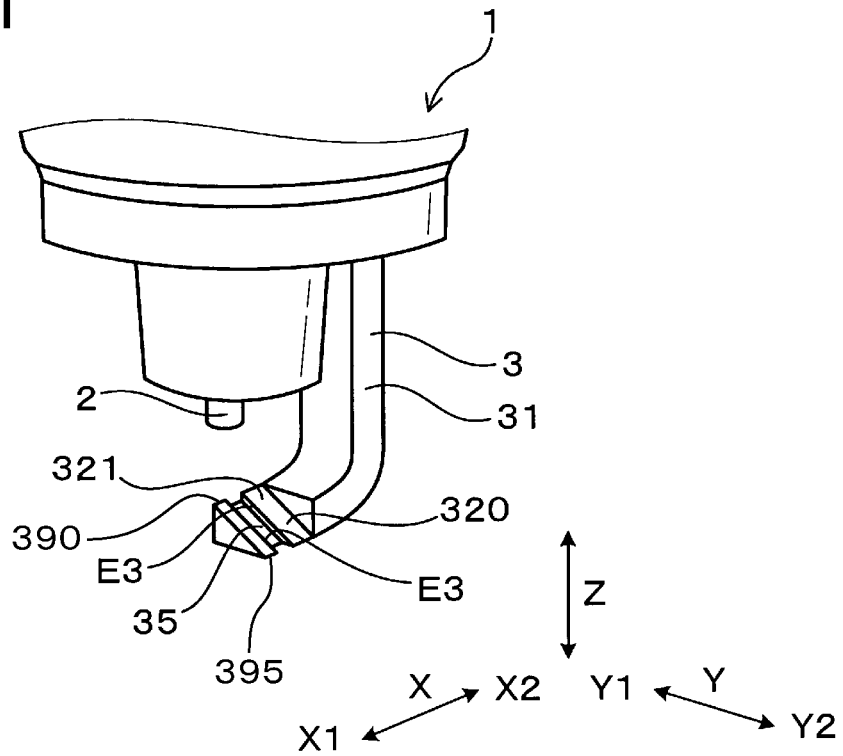
FIG. 21 is a partial perspective view which illustrates a region around a top end of a spark plug for an internal combustion engine according to the sixth embodiment.
Figure 22:
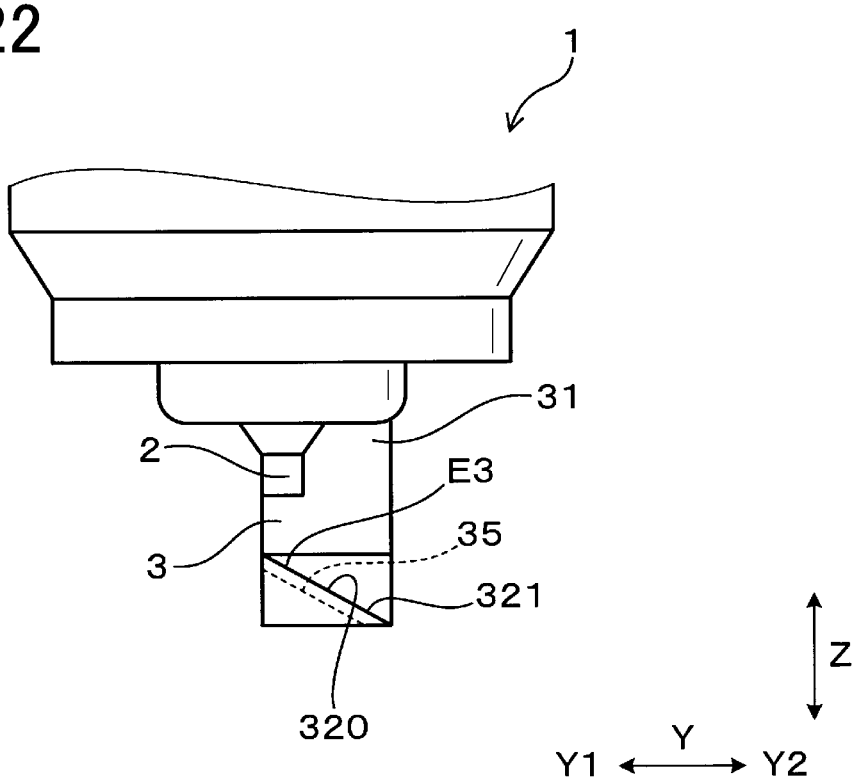
FIG. 22 is a front view which illustrates a region around a top end of a spark plug for an internal combustion engine according to the sixth embodiment.
Figure 23:
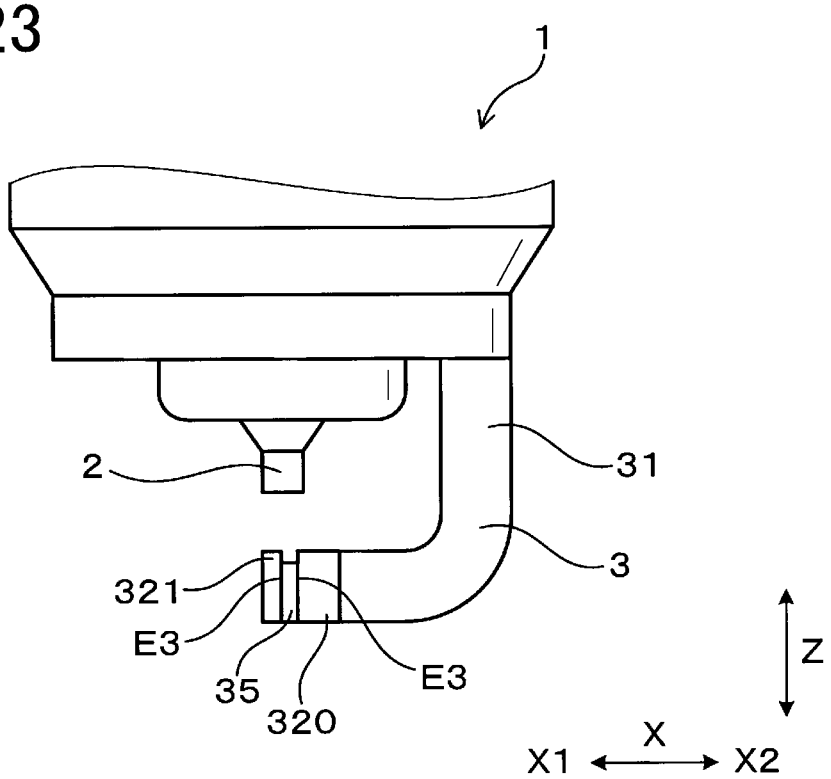
FIG. 23 is a side view which illustrates a region around a top end of a spark plug for an internal combustion engine according to the sixth embodiment.

FIGS. 21 to 23 illustrate the spark plug 1 according to the sixth embodiment which is basically identical in structure with that in the first embodiment, but has the groove 35 formed in the inner slant portion 320. The groove 35 is followed away from the top of the center electrode 2. In FIG. 22, the bottom of the groove 35 is indicated by a broken line.

The groove 35 continuously extends, as illustrated in FIG. 21, from the upstream edge 390 to the downstream edge 395 of the inner extension surface 321 in the lateral direction Y. The groove 35 has a given length oriented in a lengthwise direction of the inner slant portion 320. The groove 35 has openings lying at the upstream and downstream edges 390 and 395 of the inner slant portion 320. The groove 35 has side walls with edges E3 which lie flush with the inner extension surface 321 and face the top of the center electrode 2 in the plug axial direction Z. The edges E3 are opposed to each other in the extension lengthwise direction X. The edges E3 are inclined away from the top of the center electrode 2 to the Y2 side (i.e., the downstream side).

Other arrangements are identical with those in the first embodiment.

The groove 35 serves to facilitate concentration of electrical field around the edges E3, thereby ensuring the stability of movement of the ground starting point S1 of the spark S, thereby resulting in an increase in time it takes for the spark S to be carried downstream and then blown off and also resulting in an increase in linear distance between the starting points on the center electrode 2 and the ground electrode 3. This enhances the ability of the spark plug 1 to ignite the air-fuel mixture.

The spark plug 1 of this embodiment offers substantially the same other beneficial advantages as in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

Figure 24:
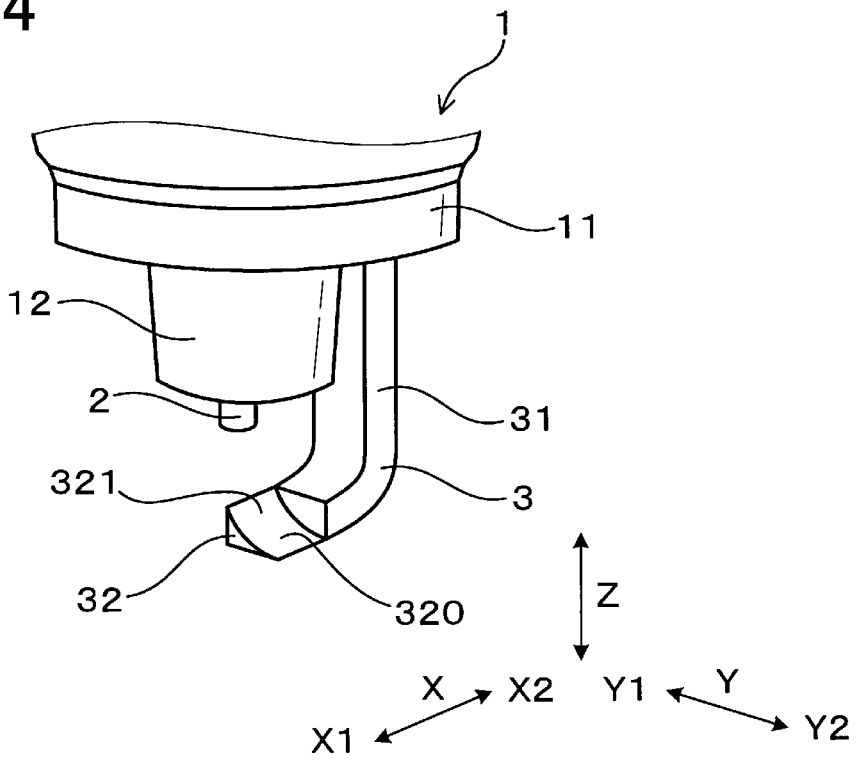
FIG. 24 is a partial perspective view which illustrates a region around a top end of a spark plug for an internal combustion engine according to the first modification.
Figure 25:
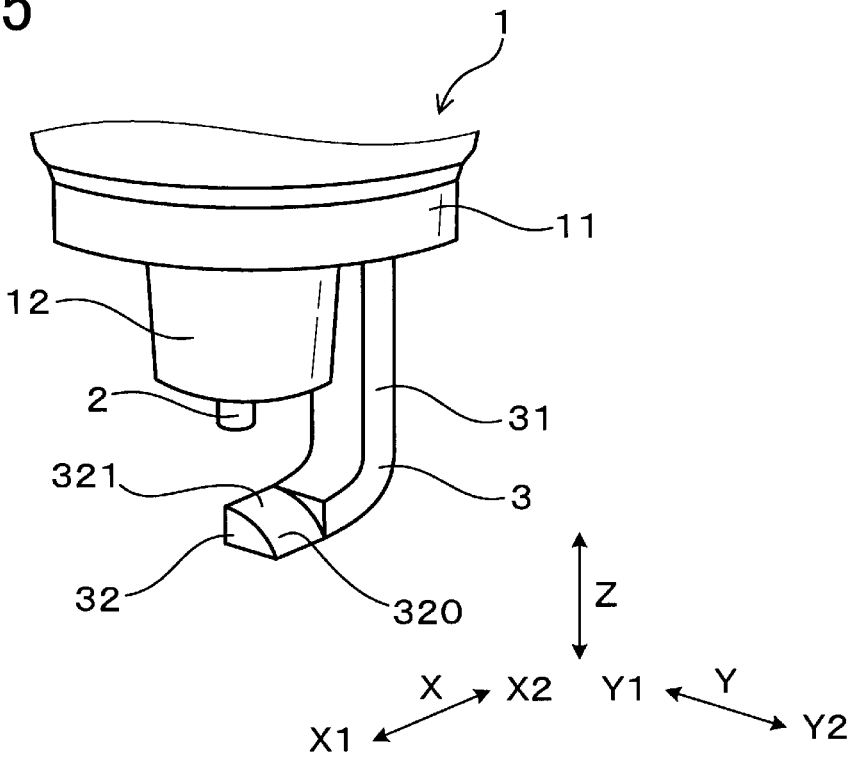
FIG. 25 is a partial perspective view which illustrates a region around a top end of a spark plug for an internal combustion engine according to the second modification.

For instance, in each embodiment, the inner slant portion 320 may be formed in the shape of a concave curve, as illustrated in FIG. 24, hollowed away from the top of the center electrode 2 or a convex curve, as illustrated in FIG. 25, bulging toward the top of the center electrode 2. Similarly, the outer slant portion 323*a* in the second embodiment may be curved.

What is claimed is:

1. A spark plug for an internal combustion engine comprising:

a hollow cylindrical housing;

a hollow cylindrical porcelain insulator which is retained inside the housing;

a center electrode which is retained inside the porcelain insulator with a top portion thereof protruding outside the porcelain insulator; and a ground electrode which defines a spark gap between itself and the center electrode, wherein the ground electrode includes an upright portion which extends from a front end of the housing to a front side of the spark plug and an extension which is bent from the upright portion inwardly in a radial direction of the spark plug, wherein if a direction which is oriented perpendicular both to an extension lengthwise direction that is a lengthwise direction of the extension and to a plug axial direction that is an axial direction of the spark plug is defined as a lateral direction, and sides opposed to each other in the lateral direction are defined as a Y1 side and a Y2 side, respectively, the extension has an inner slant portion which faces the center electrode and is inclined away from the center electrode from the Y1 side to the Y2 side, wherein the extension has a first and a second edge which are opposed to each other in the lateral direction, and the inner slant portion continuously extends from the first edge to the second edge of the extension, and wherein when viewed in the extension lengthwise direction, a center of the inner extension surface in the lateral direction is offset to the Y2 side from a center of a front end surface of the center electrode in the lateral direction.

2. A spark plug as set forth in claim 1, wherein a joint that is a portion of the upright portion which is secured to the housing is offset from the inner slant portion in the lateral direction.

3. A spark plug as set forth in claim 1, wherein the ground electrode has a length and a transverse section whose shape remains unchanged over the length.

4. A spark plug as set forth in claim 1, wherein the inner slant portion includes a convex portion protruding toward the top of the center electrode.

5. A spark plug as set forth in claim 4, wherein the convex portion comprises a rectangular elongated bar extending in a direction in which the inner slant portion is inclined.

6. A spark plug as set forth in claim 4, wherein the convex portion is located at the middle of the width of inner slant portion in the extension lengthwise direction.

7. A spark plug as set forth in claim 1, wherein a groove is formed in the inner slant portion and extends from an upstream edge to a downstream edge of inner slant portion in the lateral direction.

* * * * *